US010682661B2

(12) United States Patent
Sarajian et al.

(10) Patent No.: US 10,682,661 B2
(45) Date of Patent: Jun. 16, 2020

(54) MASKING DEVICE

(71) Applicant: Engineered Products and Services, Inc., Franksville, WI (US)

(72) Inventors: Armen Sarajian, Nashotah, WI (US); Andrew W. Oniszczuk, Pleasant Prairie, WI (US); Chad M. Cushman, Racine, WI (US)

(73) Assignee: ENGINEERED PRODUCTS AND SERVICES, INC., Franksville, WI (US)

( * ) Notice: Subject to any disclaimer, the term of this patent is extended or adjusted under 35 U.S.C. 154(b) by 0 days.

(21) Appl. No.: 16/132,976

(22) Filed: Sep. 17, 2018

(65) Prior Publication Data

US 2019/0118208 A1 Apr. 25, 2019

Related U.S. Application Data

(60) Provisional application No. 62/574,777, filed on Oct. 20, 2017.

(51) Int. Cl.
*B05B 12/24* (2018.01)
*B05D 1/32* (2006.01)

(52) U.S. Cl.
CPC ..... *B05B 12/24* (2018.02); *B05D 1/325* (2013.01); *Y10T 428/15* (2015.01)

(58) Field of Classification Search
CPC ..... Y10T 428/15; B05B 12/20; B05B 12/24; B05B 12/00; B05B 15/0487
See application file for complete search history.

(56) References Cited

U.S. PATENT DOCUMENTS

| | | | | |
|---|---|---|---|---|
| 5,017,412 | A * | 5/1991 | Bekker-Madsen .... | B65C 9/1803 428/136 |
| 9,283,585 | B2 * | 3/2016 | Isaacs ..... | B31D 1/0062 |
| 2004/0028867 | A1 | 2/2004 | Allison | |
| 2005/0255277 | A1 | 11/2005 | Syron | |
| 2008/0244867 | A1 | 10/2008 | Tuell | |
| 2009/0277577 | A1 | 11/2009 | Böhm et al. | |

FOREIGN PATENT DOCUMENTS

| | | | |
|---|---|---|---|
| JP | H0655878 | A | 3/1994 |
| JP | 3205804 | B2 | 9/2001 |
| WO | 2009049205 | A1 | 4/2009 |
| WO | 2014071362 | A1 | 5/2014 |

OTHER PUBLICATIONS

European Patent Office Search Report for Application No. 18200066.1 dated Mar. 6, 2019, 10 pages.
EPSI, "AD12 Series—Green Poly Discs," <https://www.epsi.com/ad12-series-green-poly-discs> website available as early as 2015, 4 pages.

* cited by examiner

*Primary Examiner* — Alexander S Thomas
(74) *Attorney, Agent, or Firm* — Michael Best & Friedrich LLP

(57) ABSTRACT

A masking tape may be used for covering a masking area. The masking tape includes a plurality of masking devices coupled together. Each masking device includes a perimeter and an adhesive layer. Each masking device is coupled to at least two laterally adjacent masking devices at given connection points along the perimeter. Each connection point is weak relative to the masking devices. The adhesive layer couples each masking device to a lower adjacent masking device.

17 Claims, 7 Drawing Sheets

MASKING DEVICE

CROSS-REFERENCE TO RELATED APPLICATIONS

This application claims priority to U.S. Provisional Patent Application No. 62/574,777, filed on Oct. 20, 2017, the entire contents of which are hereby incorporated by reference herein.

BACKGROUND

The present disclosure relates to masking devices, and more particularly, to a masking tape including multiple masking devices.

Masking is often used in tandem with the painting or coating of parts used in the automotive, aerospace, electronics, and other industries. The painting or coating of parts may involve liquid coating, plating, powder coating, or electroplating. The coating may be applied by a variety of methods including brushing, rolling, spraying, dipping, flow-coating, electro-static coating, and submersion in deposition tanks. The liquid, powder, or plating material may be applied to wood, fiberglass, or metal surfaces in order to protect and strengthen those surfaces. The coating protects the surface of a part by preventing electrical leakage, oxidation, corrosion and decay. The cured coating forms a very strong protective layer on the surface that is highly resistant to scratching and chipping.

In most applications, a protective coating is applied to only specific areas of a surface. The areas which will not receive the coating must be covered or masked off. Typically, a paper or polyester film element in the form of masking tape is applied to the surface areas to be masked. The masking tape generally has an adhesive on one side so that it may be affixed to the surface to be masked. Once the painting or coating process has been completed, the masking tape is removed from the surface.

SUMMARY

In one aspect, the disclosure provides a masking tape for covering a masking area. The masking tape includes a plurality of masking devices coupled together. Each masking device includes a perimeter and an adhesive layer. Each masking device is coupled to at least two laterally adjacent masking devices at given connection points along the perimeter. Each connection point is weak relative to the masking devices. The adhesive layer couples each masking device to a lower adjacent masking device.

In another aspect, the disclosure provides a masking tape for covering a masking area. The masking tape includes a plurality of masking devices. Each masking device is coupled to a laterally adjacent masking device. Each masking device includes a carrier film having a top surface and a bottom surface opposite the top surface, an adhesive layer connected to the bottom surface of the carrier film, and an adhesion-reduction layer connected to the top surface of the carrier film. The adhesion-reduction layer includes fluorosilicate.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1A:
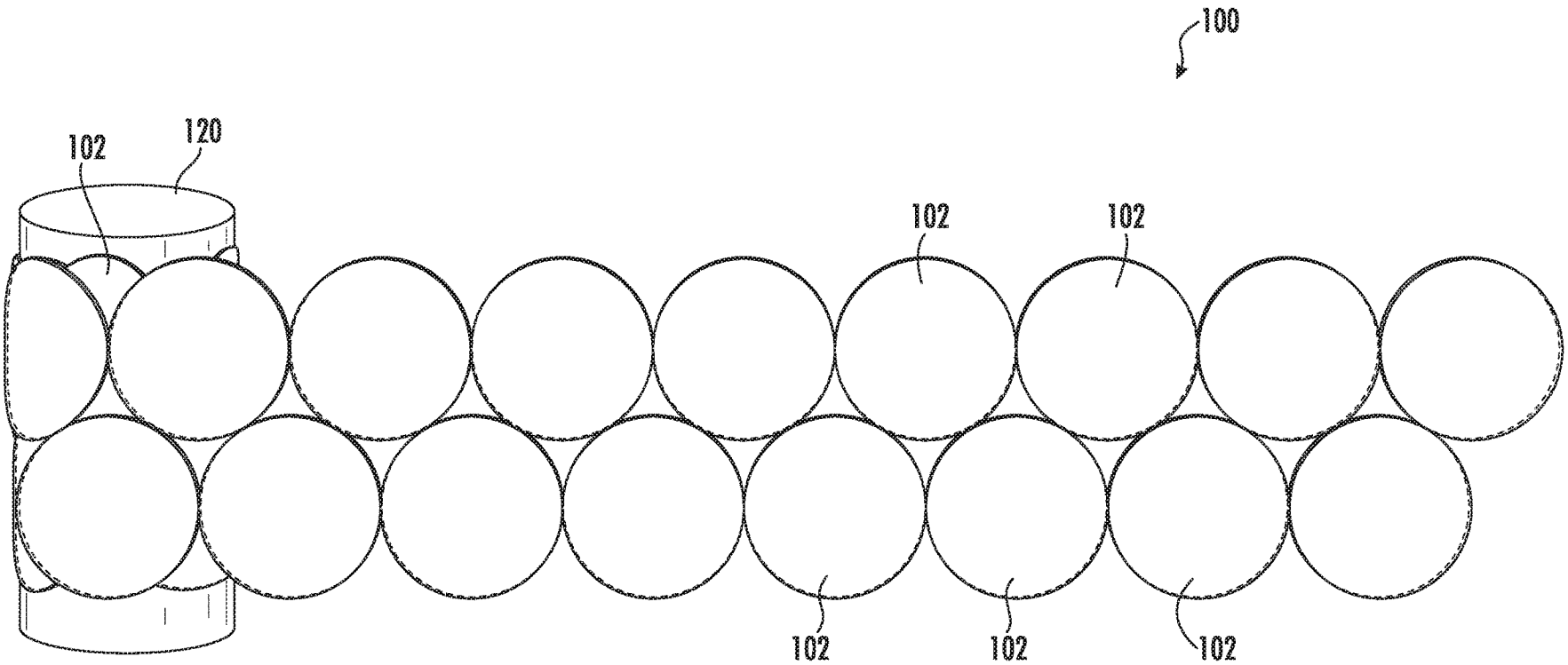
FIG. 1A is a perspective view of a masking tape.
Figure 1B:
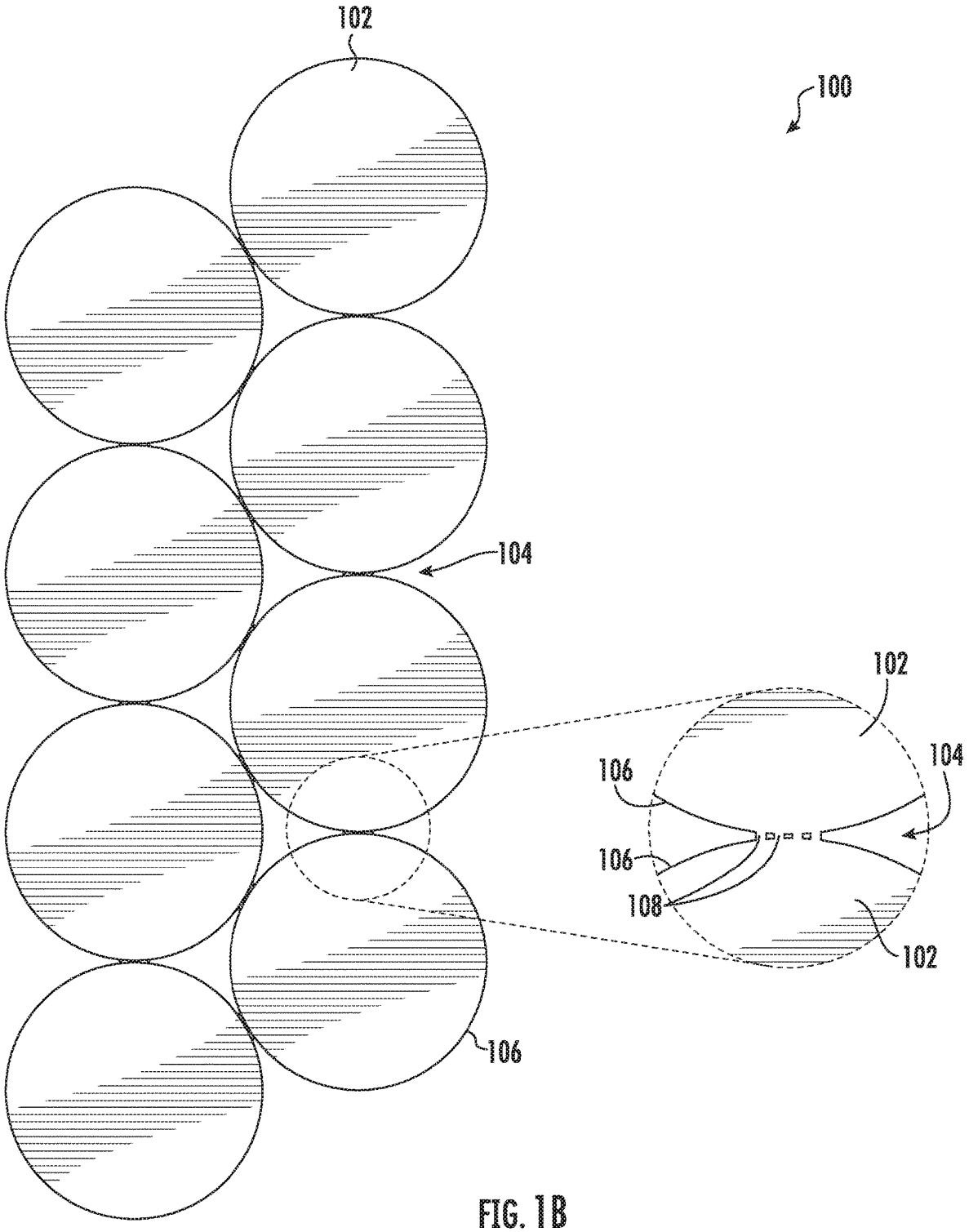
FIG. 1B is a plan view of the masking tape of FIG. 1A.

FIGS. 1A and 1B illustrate a masking tape 100 for covering a masking area. The masking tape 100 includes a plurality of masking devices 102. The masking devices 102 are coupled together to form the masking tape 100. Each masking device 102 is coupled to at least two laterally adjacent masking devices. In some embodiments, each masking device 102 is coupled to at least three laterally adjacent masking devices. In such embodiments, the plurality of masking devices 102 includes two rows of masking devices. The rows are shown staggered relative to one another, such that each masking device 102 is coupled to four laterally adjacent masking devices. Of course, the present disclosure contemplates more than two rows of masking devices 102. Furthermore the present disclosure contemplates each masking device 102 coupled to more than four laterally adjacent masking devices, such as five or six laterally adjacent masking devices. The rows of masking devices 102 may or may not be staggered relative to each other, and some embodiments include some rows staggered relative to each other while other rows are aligned with each other. With regard to the illustrated embodiment, however, staggering the rows of masking devices 102 provides a close packing of the masking devices along the masking tape 100. The staggered configuration also provides a wider and consequently more stable masking tape 100 to avoid inadvertent tearing off of any masking devices 102.

The couplings between masking devices 102 are at given connection points 104 along a perimeter 106 of each masking device. Each connection point 104 may be weak or weakened relative to the other portions of the masking devices 102. In the illustrated embodiment, each connection point 104 is of the same material as the plurality of masking devices 102. Particularly, the connection point 104 includes a relatively narrow continuation 108 of the material of the masking devices 102. As shown in FIG. 1B, more than one relatively narrow continuation 108 may connect adjacent masking devices 102 at the connection point 104. As such, the multiple relatively narrow continuations 108 make up a perforated seam for the connection point 104. These perforated seam connection points 104 may include relatively narrow continuations 108 of the material of the masking devices 102 that are separated from each other by gaps. The alternating pattern of relatively narrow continuations 108 and adjacent gaps defines, in some embodiments, a perforated seam connection point 104 with at least sixteen relatively narrow continuations per inch of the length of the perforated seam connection point. Stated another way, each relatively narrow continuation 108 is no larger than 1/32" wide in some embodiments. The relatively narrow continuations 108 are illustrated as having consistent widths, but the current disclosure also contemplates relatively narrow continuations of varying widths. The gaps between the relatively narrow continuations 108 may have widths that are equal to or different from the relatively narrow continuations 108. In the illustrated embodiment, the gaps have a width that is identical to the relatively narrow continuations 108 such that the relatively narrow continuations are evenly spaced from each other along the perforated seam connection point 104. Connecting adjacent masking devices 102 with the same material as the remainder of the masking devices allows a manufacturer to form the masking tape 100 quickly and easily. In the illustrated embodiment, for example, a manufacturer may make the masking tape 100 by molding the tape as shown or by cutting the tape from a single strip of the masking tape material. During manufacturing of the masking tape 100 according to this cutting process, the masking tape is conveyed along a series of guide rollers towards a rotary die, at which point the rotary die cuts the masking tape to form the staggered configuration and perforated seam connection points 104. Once the masking tape 100 passes the rotary die, strips of the masking tape may be stacked on each other or a single continuous masking tape may be wrapped into a roll to provide an easy way to package the masking tape for transportation, sale, or use.

In the illustrated embodiment, perforated seam connection points 104 are integrated into the perimeter 106 of the masking devices 102. Stated another way, the relatively narrow continuations 108 of the material of the masking devices 102 are formed by simply refraining from cutting out the entirety of each of the masking devices from the original sheet of material. The perimeters 106 of adjacent masking devices 102 touch each other at the relatively narrow continuations 108 in this embodiment. The illustrated embodiment of FIGS. 1A and 1B include circular masking devices 102. The perimeter 106 of each masking device, therefore, includes a curve, and the perforated seam connection points 104 extend tangentially along the curve. Other curved masking devices 102 are also contemplated herein including, but not limited to, oval or ellipse shaped masking devices.

Figure 4:
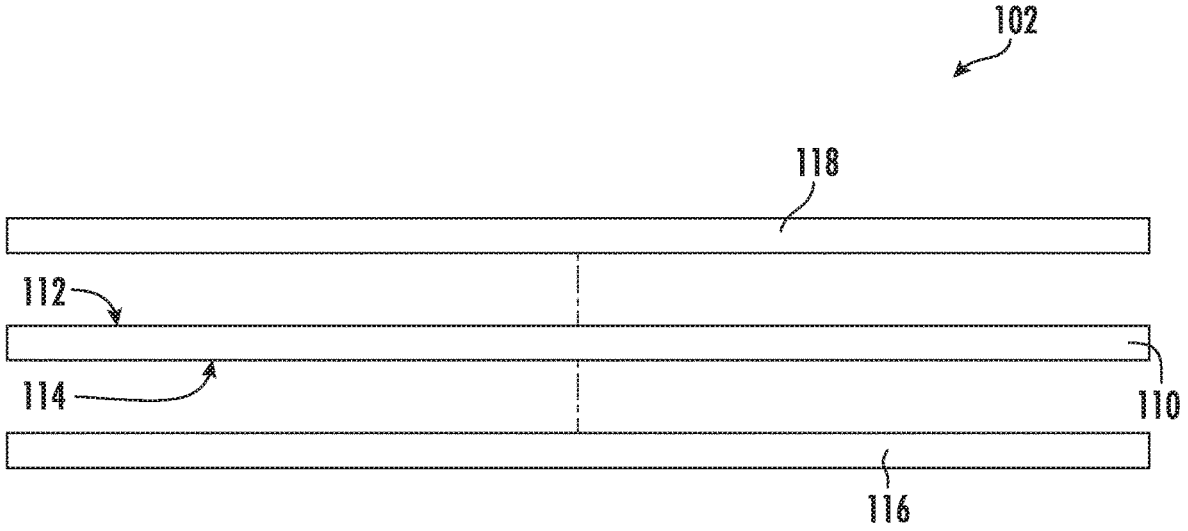
FIG. 4 is a schematic exploded side elevation view of the layers of the masking tape.

Turning now to FIG. 4, the masking tape 100 includes multiple layers. The masking tape 100 includes a carrier film 110 having a top surface 112 and a bottom surface 114 opposite the top surface. The carrier film 110 may be composed of a polyethylene material. In other embodiments, the carrier film 110 is composed of other suitable materials, such as a polypropylene, a polystyrene, or a polyvinyl chloride. In one exemplary embodiment, polyethylene terephthalate (PET) may be used for its high temperature resistance and other desirable properties.

The bottom surface 114 of the carrier film 110 is configured to face the masking area, and an adhesive layer 116 is provided on the bottom surface. The adhesive layer 116 allows each masking device 102 to maintain contact with the masking area until a user removes the masking device from the masking area. The adhesive layer 116 of each masking device 102 may be a silicone-based adhesive having a peel adhesion of approximately 25-40 ounces per inch. The adhesive layer 116 may also have a thickness of approximately 0.025 to 0.1 millimeters. In a specific exemplary embodiment, the adhesive layer 116 has a peel adhesion of 35 ounces per inch and a thickness of approximately 0.04 millimeters. In some embodiments, the adhesive of the adhesive layer 116 could alternatively be a resin-based adhesive, an acrylic-based adhesive, a rubber-based adhesive, or other similar type of adhesive. Still, in other embodiments, the adhesive of the adhesive layer 116 could include a curing agent.

With continued reference to FIG. 4, the top surface 112 of the carrier film 110 of each masking device 102 is provided with an adhesion-reduction layer 118 connected thereto. In an exemplary embodiment, the adhesion-reduction layer 118 includes fluorosilicate, such that the adhesion-reduction layer is a fluorosilicate layer. With an adhesion-reduction layer 118 on the top surface 112 of the carrier film 110 of the masking devices 102, the masking tape 100 may be wrapped around itself onto a core 120, such as a hollow roll. The adhesion-reduction layer 118 allows each masking device 102 to couple to a lower adjacent masking device, either by stacking strips of the masking tape 100 or by placing the masking tape about a core 120 to form a roll of masking tape. Stated another way, the masking tape 100 wrapped about the core 120 forms a roll of masking devices 102 including outer masking devices and inner masking devices. The adhesive layer 116 of each outer masking device 102 removably connects the outer masking device to a corresponding adhesion-reduction layer 118 of an inner adjacent masking device. The layers of masking devices 102 need not be lined up, and staggered alignment with an outer masking device removably connected to more than one inner adjacent masking device is acceptable. With the inclusion of an adhesion-reduction layer 118, the masking devices 102 are releasably connected to a lower layer of masking devices without the need for making an adhesive layer 116 with a peel adhesion that is undesirably weak, thereby preventing sticking issues when placing the masking device on a masking area. Neither the upper masking device 102 nor the lower adjacent masking device is damaged upon removal of the upper masking device from the roll or stack.

Conventionally, masking tapes similar to the masking tape 100 include a plastic (i.e., polyester film) liner to maintain separation from adjacent and stacked masking devices (such as the illustrated masking devices 102) so the masking devices are inhibited from sticking to each other. However, the masking tape 100 discussed herein avoids the use of such a plastic liner, thereby allowing for significant cost, transportation, and storage savings.

In operation, a user unwraps a portion of the masking tape 100 from the roll formed about the core 120, causing the masking tape to release from itself as a result of the adhesive layer 116 releasably sticking to the adhesion-reduction layer 118 on the top surface 112 of the carrier film 110. At this point, the user pulls one of the masking devices 102 with sufficient force to tear the relatively narrow continuation 108 of the material of the masking devices, thereby separating the masking device from the adjacent masking devices. Subsequently, the masking device 102 is simply applied to the desired masking area. After the masking area has been coated, the masking device 102 is removed from the masking area by pulling upwardly on the perimeter 106 of the masking device.

Figure 2A:
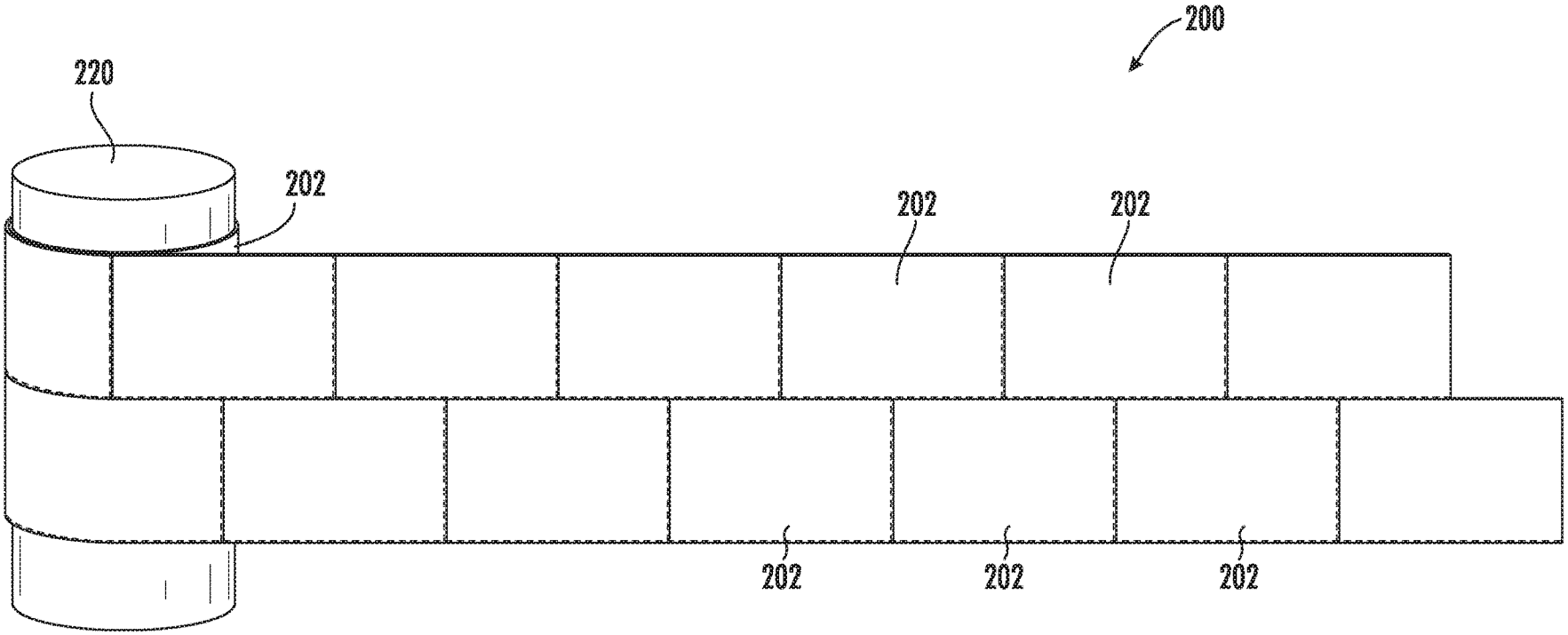
FIG. 2A is a perspective view of another masking tape.
Figure 2B:
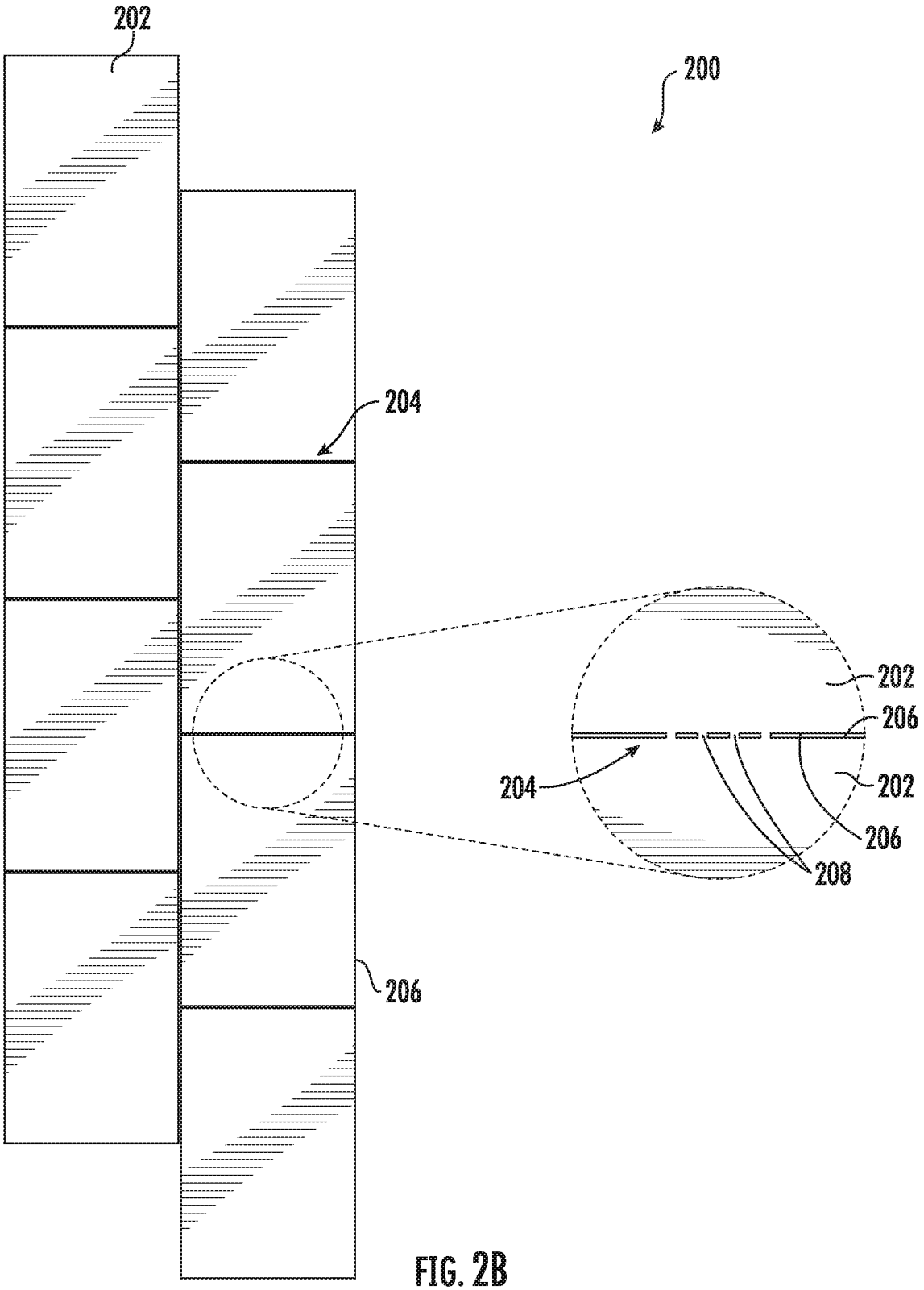
FIG. 2B is a plan view of the masking tape of FIG. 2A.
Figure 3A:
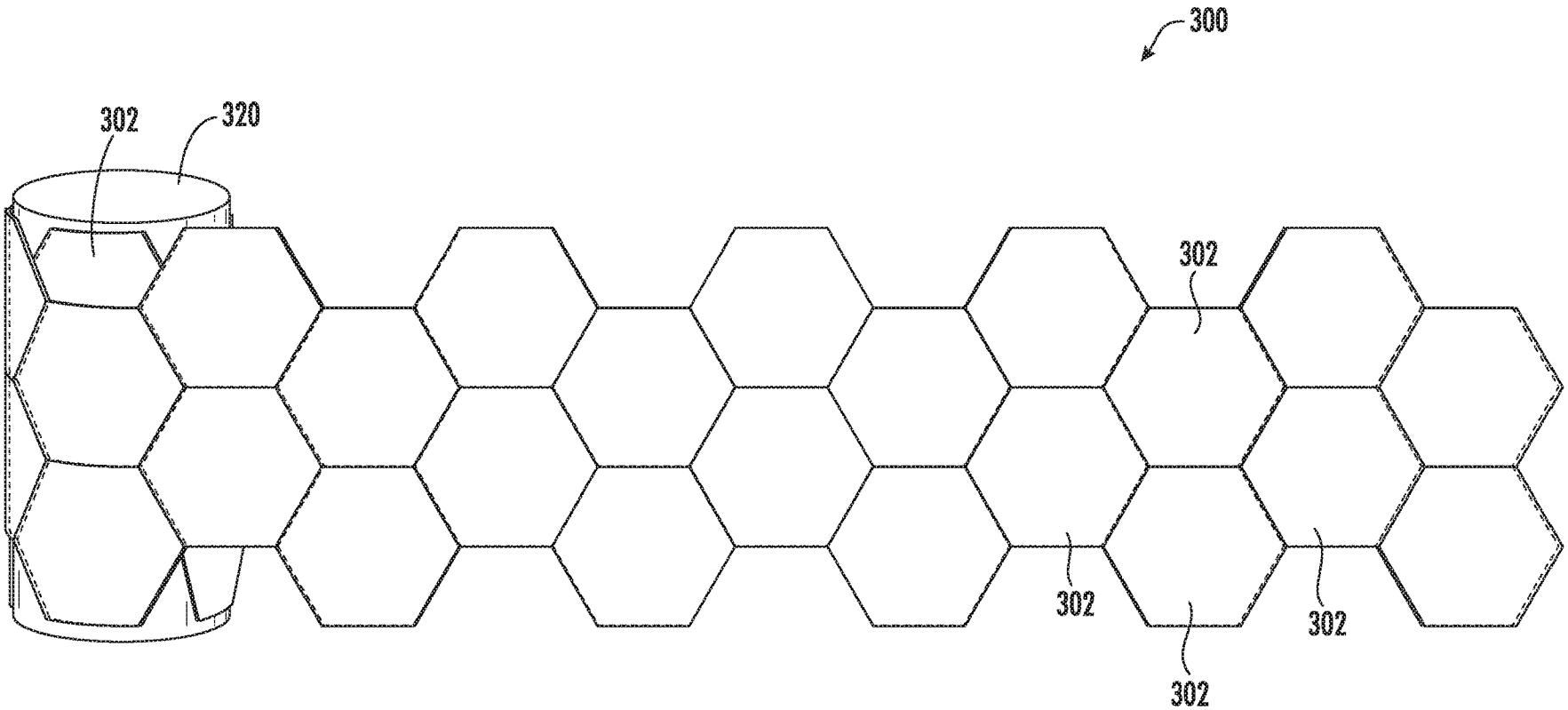
FIG. 3A is a perspective view of yet another masking tape.
Figure 3B:
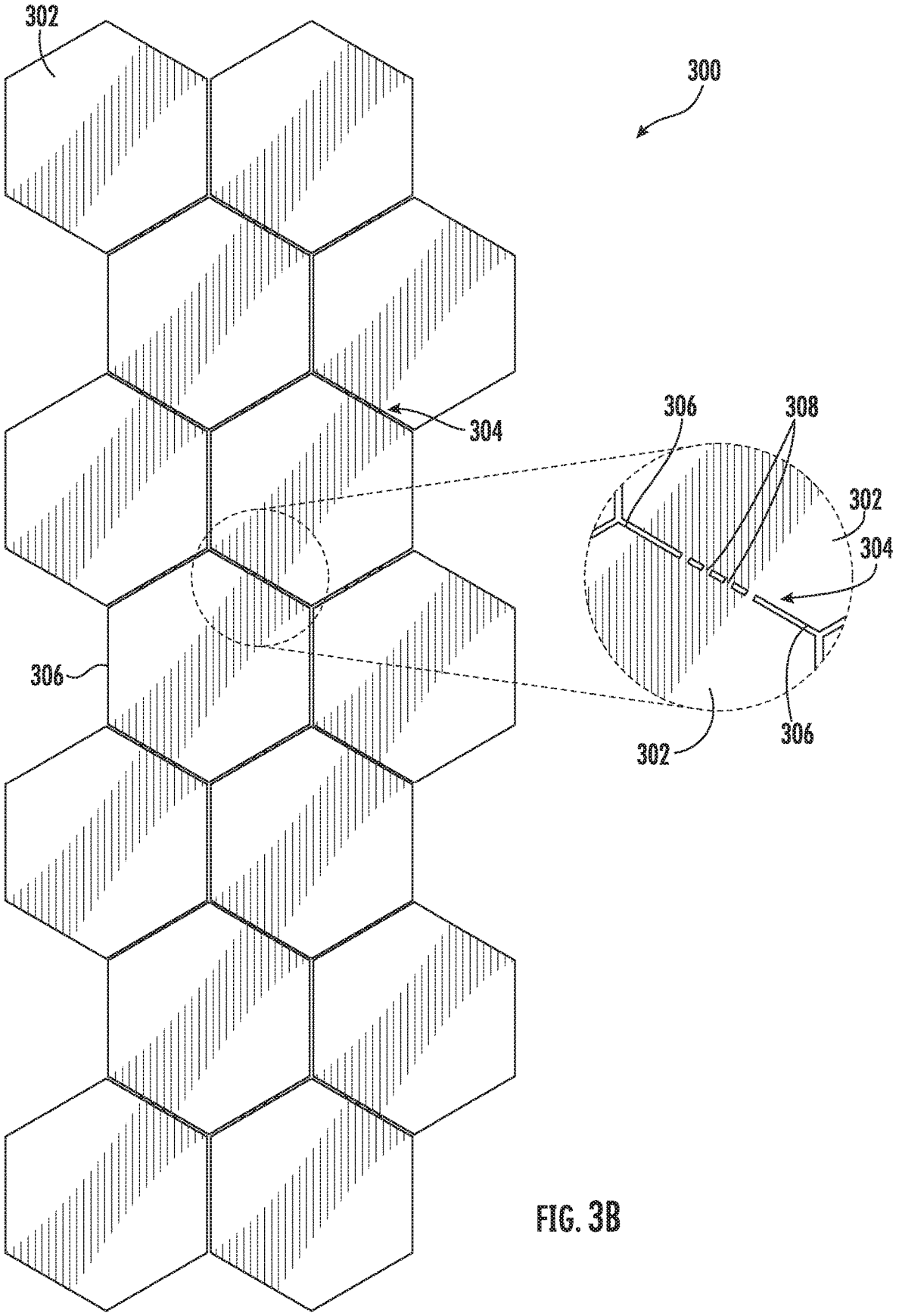
FIG. 3B is a plan view of the masking tape of FIG. 3A.

Any appropriate sizes and shapes of masking devices are contemplated herein. Although circular masking devices 102 have been discussed above and shown in FIGS. 1A and 1B, other shapes are considered herein. For instance, rectangular masking devices 202 are shown in FIGS. 2A and 2B. All components of the masking tape 200 shown in FIGS. 2A and 2B have the same reference number as those discussed above, but with a number that is higher by one-hundred. Masking devices such as hexagonal masking devices 302 are also contemplated herein (shown in FIGS. 3A and 3B). All components of the masking tape 300 shown in FIGS. 3A and 3B have the same reference number as those discussed above, but with a number that is higher by two-hundred. Because the possible layers and materials of the masking tapes 100, 200, 300 may be identical, the layers illustrated in FIG. 4 have only been discussed with regard to the masking tape having circular masking devices 102. Also, although the masking devices 102, 202, 302 have all been shown being of a uniform shape and size on the respective masking tapes 100, 200, 300, this disclosure contemplates a single masking tape having masking devices that vary in size and/or shape relative to one another.

The above discussion should not be taken as limiting with regard to the current disclosure. Multiple possible embodiments not explicitly discussed herein are contemplated with this disclosure. Features from one embodiment may replace or supplement features from another embodiment to form still another embodiment. Other changes, additions, and/or subtractions to the designs discussed herein are also contemplated.

What is claimed is:

1. A masking tape for covering a masking area, the masking tape comprising:

a plurality of masking devices coupled together, the plurality of masking devices including two rows of masking devices, the rows staggered relative to one another, each masking device being circular and including:

a perimeter; and an adhesive layer;

wherein each masking device is coupled to at least four laterally adjacent masking devices at given connection points along the perimeter, each connection point being weak relative to the masking devices; and wherein the adhesive layer couples each masking device to a lower adjacent masking device.

2. The masking tape of claim 1, wherein each connection point is of a same material as the plurality of masking devices; and the connection point includes a relatively narrow continuation of the material of the masking devices.

3. The masking tape of claim 1, wherein each connection point includes a perforated seam.

4. The masking tape of claim 1, wherein:

the perimeter of each masking device includes a curve; and the perforated seam extends tangentially along the curve of the perimeter at the connection point.

5. The masking tape of claim 1, wherein the masking devices are positioned over each other as a roll of masking devices.

6. The masking tape of claim 1, wherein the masking devices are of a uniform size.

7. The masking tape of claim 1, wherein the masking devices are of a uniform shape.

8. The masking tape of claim 1, wherein each masking device includes a carrier film having a top surface and a bottom surface opposite the top surface;

the adhesive layer connected to the bottom surface of the carrier film; and an adhesion-reduction layer connected to the top surface of the carrier film; and wherein the adhesion-reduction layer includes fluorosilicate.

9. The masking tape of claim 8, wherein the carrier film includes a polyethylene material.

10. The masking tape of claim 8, wherein the adhesive layer includes a silicone based adhesive.

11. The masking tape of claim 10, wherein the adhesive layer includes a thickness of between 0.025 and 0.1 millimeters.

12. The masking tape of claim 11, wherein the thickness of the adhesive layer is 0.04 millimeters.

13. The masking tape of claim 8, wherein the adhesive layer includes a peel adhesion of between 25 and 40 ounces per inch.

14. The masking tape of claim 13, wherein the peel adhesion of the adhesive layer is 35 ounces per inch.

15. The masking tape of claim 8, wherein the plurality of masking devices are positioned over each other as a roll of masking devices.

16. The masking tape of claim 15, wherein the roll of masking devices includes outer masking devices and inner masking devices, the adhesive layer of each outer masking device removably connecting the outer masking device to a corresponding adhesion-reduction layer of an inner masking device.

17. The masking tape of claim 8, wherein a perforated seam couples each masking device to the laterally adjacent masking device.

* * * * *